US006946781B2

(12) United States Patent
Ricaud

(10) Patent No.: US 6,946,781 B2
(45) Date of Patent: Sep. 20, 2005

(54) CATHODE WITH OPTIMIZED THERMAL EFFICIENCY

(75) Inventor: Jean-Luc Ricaud, Dijon (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 226 days.

(21) Appl. No.: 10/297,657

(22) PCT Filed: Jun. 7, 2001

(86) PCT No.: PCT/FR01/01763

§ 371 (c)(1),
(2), (4) Date: Dec. 9, 2002

(87) PCT Pub. No.: WO01/99140

PCT Pub. Date: Dec. 27, 2001

(65) Prior Publication Data

US 2003/0164667 A1 Sep. 4, 2003

(30) Foreign Application Priority Data

Jun. 21, 2000 (FR) ..... 00 07911

(51) Int. Cl.[7] ..... H01J 29/04; H01J 29/48
(52) U.S. Cl. ..... 313/310; 313/446; 313/456
(58) Field of Search ..... 313/310, 346, 313/446, 456, 627–629, 337–340, 270, 448, 346 R, 346 DC

(56) References Cited

U.S. PATENT DOCUMENTS

| | | | | | |
|---|---|---|---|---|---|
| 3,566,179 | A | * | 2/1971 | Kumpfer | 313/337 |
| 4,279,784 | A | * | 7/1981 | Misumi et al. | 252/513 |
| 4,403,169 | A | * | 9/1983 | Blanken | 313/446 |
| 4,912,362 | A | * | 3/1990 | Barthelemy et al. | 313/270 |
| 4,990,823 | A | * | 2/1991 | Swaving et al. | 313/446 |
| 5,013,965 | A | * | 5/1991 | Shon et al. | 313/446 |
| 5,117,153 | A | * | 5/1992 | Do | 313/447 |
| 5,313,133 | A | * | 5/1994 | Park | 313/270 |
| 5,444,327 | A | * | 8/1995 | Treseder et al. | 313/337 |

FOREIGN PATENT DOCUMENTS

| | | | |
|---|---|---|---|
| EP | 373511 | 6/1990 | H01J/1/20 |
| EP | 632479 | 1/1995 | H01J/1/22 |
| FR | 1303636 | 2/1963 | |
| FR | 1422700 | 3/1966 | |
| JP | 60-150536 | 8/1985 | H01J/1/20 |
| WO | 91/03065 | 3/1991 | H01J/1/15 |

OTHER PUBLICATIONS

Patent Abstracts of Japan, vol. 009, No. 318, Dec. 13, 1985 and JP 60–150536.

* cited by examiner

*Primary Examiner*—Joseph Williams
*Assistant Examiner*—Dalei Dong
(74) *Attorney, Agent, or Firm*—Joseph S. Tripoli; Harvey D. Fried; Richard LePeruta, Jr.

(57) ABSTRACT

A cathode structure for an electron gun of a cathode-ray tube having a reduced size and providing a fast cathode start-up time and excellent thermal efficiency. The cathode comprises a closed chamber consisting of a cap supporting an emitting part of the cathode and a dish-shaped skirt having an internal surface which is concave so as to reflect, by radiation, the thermal energy stored in the skirt walls, towards that region of the cap supporting the emitting part. The cathode structure also comprises filament supply leads which pass through the side walls of the skirt and connect to the filament heater contained in the closed chamber.

14 Claims, 2 Drawing Sheets

FIG. 1
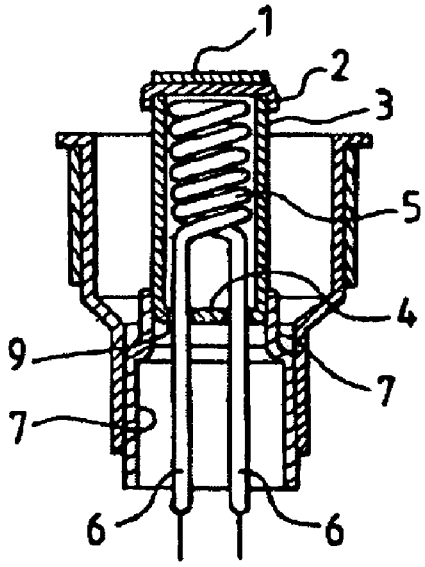
PRIOR ART
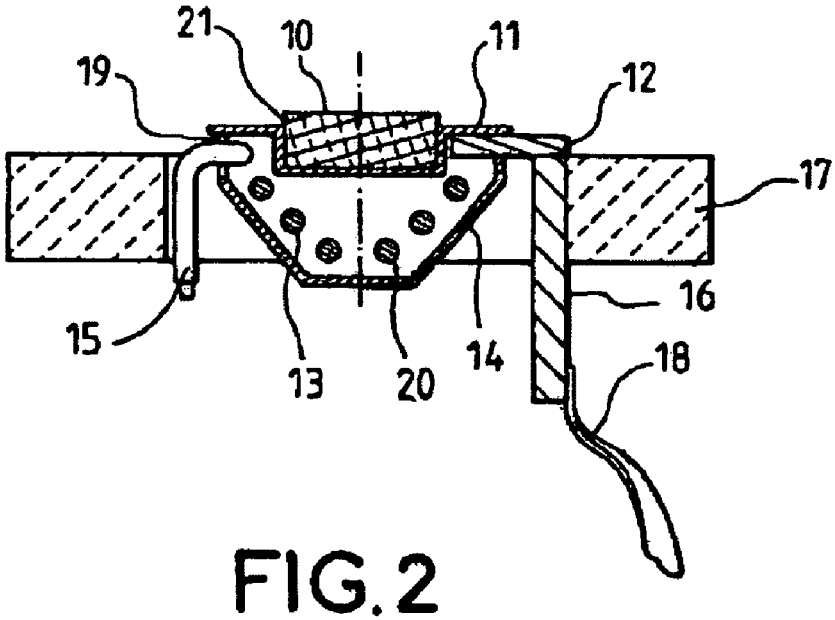
FIG. 2

CATHODE WITH OPTIMIZED THERMAL EFFICIENCY

This application claims the benefit, under 35 U.S.C. § 365 of International Application PCT/FR01/01763, filed Jun. 7, 2001, which was published in accordance with PCT Article 21(2) on Dec. 27, 2001 in French and which claims the benefit of French patent application No. 0007911 filed Jun. 21, 2000.

The invention relates to a cathode for an electron gun of a cathode-ray tube, the structure of which is improved with a view to reducing the length of the cathode and improving the thermal efficiency of the cathode.

BACKGROUND OF THE INVENTION

A cathode for an electron gun of a cathode-ray tube in general comprises a cap on which a material intended to emit an electron beam is placed, a cylindrical-shaped cathode skirt forming, with the cap, a unitary assembly, a heater filament inserted in the skirt, the filament comprising in general a spiral part placed close to the cap and the leads for connection to the power supply circuit, this connection being made via the skirt orifice situated opposite the cap; the filament leads are welded to rigid yokes secured to the structure of the gun through electrically non-conducting parts made, for example, of glass. The cathode itself is held in place in the lower part of the gun using a sleeve secured, for example by welding, to the end of the skirt opposite the cap. Such a structure is, for example, described in U.S. Pat. No. 4,403,169.

In a gun of this type, part of the power provided by the filament to take the emitting part to its operating temperature, is lost by radiation at the rear opening of the cathode skirt. Furthermore, a lot of power is lost through the cathode support means in the gun, such as the sleeve mentioned above. In order to improve the thermal efficiency of the cathode, U.S. Pat. No. 5,013,965 describes the use a cylindrical cathode skirt having the particular feature of being closed at the end opposite the cap. This configuration improves the thermal efficiency of known cathodes by heat conduction from the skirt to the emitting part, but in an insufficient manner and in particular it does not especially speed up the cathode startup time, an important characteristic for rapidly obtaining an image on a television screen.

A cathode according to the prior art, as illustrated in FIG. 1, comprises an emitting part 1 in the form of a layer of emitting material for an oxide cathode or of a pellet impregnated with emitting materials in the case of a so-called impregnated cathode. The emitting material is supported by a cathode cap 2, placed at one of the ends of a cylindrical skirt 3; the skirt 3 lies in a direction Z perpendicular to the emitting surface of 1; the skirt 3 is closed at its end 4 opposite the cap, so as to form a closed cylinder in which the cathode filament 5 is enclosed; the filament leads pass through the cathode skirt via orifices 9 made in the end 4 opposite the cap. The cathode is supported in the structure of the gun by a sleeve 7 connected in a conventional manner to the other parts of the electron gun.

However, this type of structure has two major drawbacks:

- its length along the main axis Z is large and contributes to extending the length of the electron gun which incorporates it and consequently, the depth of the tube fitted with such a gun; and
- the thermal efficiency of such a cathode is not optimized. A lot of energy is lost in the skirt and in the means for connecting the skirt to the other parts of the gun.

SUMMARY OF THE INVENTION

The cathode for an electron gun of a cathode-ray tube according to the invention comprises emitting materials to generate an electron beam; a metal cap on which the emitting part is placed; a spiral-shaped heater filament placed under the cap and terminated by connection leads, a skirt surrounding the spiral part of the filament and forming, with the cap, a closed space.

One improvement lies in that the internal surface of the rear part of the skirt opposite the cap reflects heat energy from the filament to the emitting part thereby providing fast cathode start-up time and excellent thermal efficiency. In one embodiment, the internal surface of the skirt is preferably thereby efficiently reflecting, by radiation, the thermal energy stored in the skirt walls, towards that region of the cap supporting the emitting parts.

Another separate or included improvement lies in that the connection leads pass through the side walls of the skirt, preferably closest to the junction between the cap and the skirt.

BRIEF DESCRIPTION OF THE DRAWINGS

The invention will now be described in greater detail, with relation to the accompanying drawings in which:

FIG. 1 is a sectional view of a cathode according to the prior art;

FIG. 2 is a sectional view of a first embodiment of the invention;

DETAILED DESCRIPTION OF THE PREFERRED EMBODIMENTS

Figure 3:
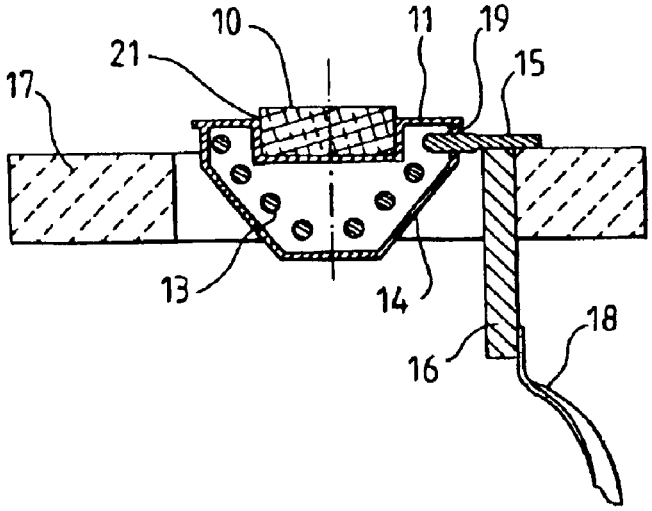
FIG. 3 illustrates a second embodiment of the invention.

The cathode according to the invention, shown in a first embodiment in FIG. 2, has a length along the Z axis which is shorter in comparison with the prior art. FIG. 2 illustrates one embodiment in the case of an impregnated cathode, but can be applied in the same way to an oxide cathode.

The cathode comprises a metal cap 11 supporting a pellet 10 of porous materials impregnated with emitting materials. A metal skirt 14 is attached to the cap. Unlike the prior art, the two connection leads 15 of the filament 13 pass, not through the bottom of the skirt 14, but through its side wall via orifices or notches 19. These orifices or notches are preferably placed close to the cap 11, or else at the end of the skirt 14 closest to the cap. The cathode, consisting of its emitting part 10, the cap 11, its skirt 14 and the filament 13, is held in place using an electrically insulating support 17 made, for example, of sintered glass, the mechanical connection between the support 17 and the cathode/filament assembly (emitting part 10, cap 11, filament 13, and skirt 14) is made by a plurality of arms 12, welded to metal pads 16 included in the insulating support 17. The number of these arms may, for example, be three, placed at 120° to each other; they preferably lie in a plane substantially parallel to the support surface 17 and to the surface of the emitting part 10 of the cathode in order to reduce the axial length of the cathode. As illustrated in section in FIG. 2, one of the arms 12 acts as an electrical connection to bring the cathode to an ad hoc potential using a connector 18 connected to a power source. The filament 13 has a coating which ensures electrical insulation between, on the one hand, the conducting core of the filament electrically connected to the leads 15 and, on the other hand, the emitting part 10, cap 11, arms 12, skirt 14, electrically conducting pads 16 and connector 18 are electrically connected to each other. For example, this coating lies over the entire part of the filament contained in the space defined by the cap 11 and the skirt 14, and also lies beyond the orifices 19.

Figure 4:
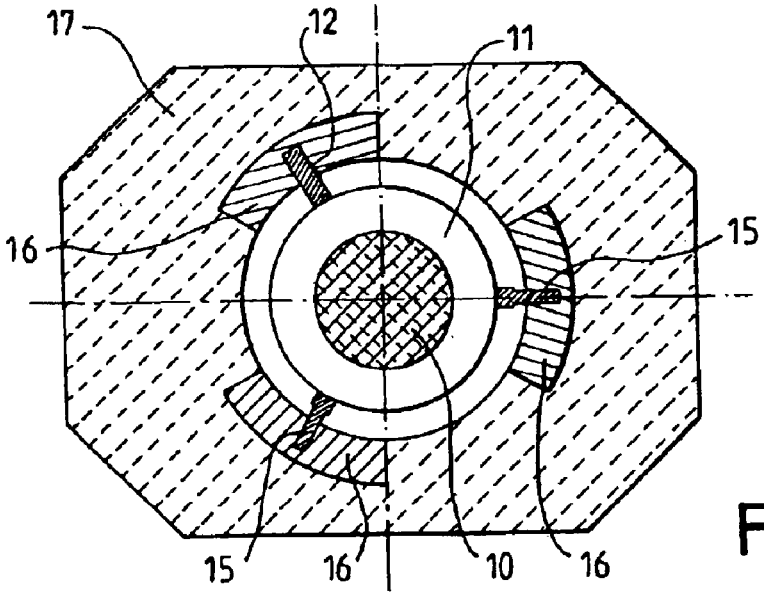
FIG. 4 is a top view of a cathode according to the invention.
Figure 5:
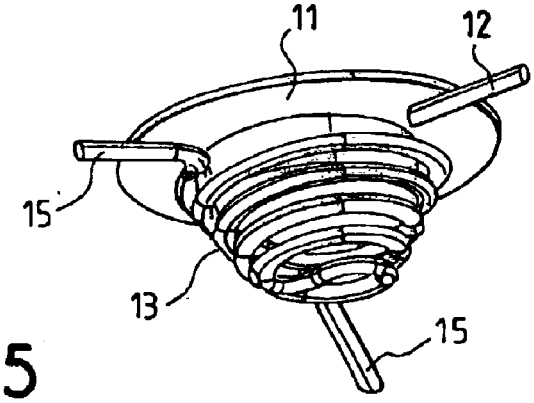
FIG. 5 is a perspective view of the emitting part and of the coiled filament of a cathode according to the invention.

In a second embodiment of the invention illustrated in FIG. 3, FIG. 4 and FIG. 5, the two connection leads 15 of the filament are used as cathode support arms, the leads being connected, for example by welding, to pads 16 included in the insulating support 17. In this case, the two filament leads are able to pass through the side part of the skirt 14, at 120° to each other, in a plane parallel to the surface of the emitting part 10. Mechanical stability is ensured by at least one arm 12, in this case placed at 120° to the two leads 15. The cathode is assembled, for example, as follows:

the filament 13, with its two leads lying at 120° to each other, is placed under the cap 11, to which an arm 12 has been previously welded;

the skirt 14, having on its periphery three notches 19 at 120° to each other, is attached to the cap 11 so that the leads 15 and the arm 12 pass through the notches 19. The dimensions of the notches are matched to the dimensions of the leads 15 and of the arm 12 so as to achieve a close fit in order to prevent any subsequent movement of these components during operation;

the skirt 14 is secured, for example by welding, to the cap 11; and the leads 15 and the arm 12 are secured, for example by welding, to metal pads 16 included in the insulating support 17.

The unitary module thus produced can be inserted alone or in threes, in the lower part of an electron gun for a monochrome or colour cathode-ray tube. In one advantageous embodiment, the first electrode of the gun comprises means into which the cathode module is inserted in order to keep the emitting part of the cathode facing the orifice of the grid and at a good distance from it.

The invention thus allows especially the axial length of the cathode to be reduced, but also allows the thermal efficiency of the latter to be increased.

In the cathode structure according to the invention, it is henceforth possible to close the lower part, opposite the cap 11, so that it acts as a heat reflector by reflecting the radiant heat energy directly onto the emitting part of the cathode. The concave shape of the internal surface of the lower part of the skirt is designed to carry out this function of reflecting energy onto the cap 11 area supporting the emitting part 10; thus the internal surface of the closed lower part of the skirt can have any concave shape designed to carry out this function; preferably, it may have a conical or frustoconical shape which is easy to produce industrially, the apex angle of the cone being chosen so that a part of the heat which is not directly picked up by the emitting part 10 is sent by radiative reflection to the cap area supporting the emitting part 10.

In order to improve the heat exchange between the filament and the emitting part, the shape of the filament 13 is adapted so as to match the internal surface of the skirt; thus, the head 20 of the filament has a size in a plane parallel to the plane of the emitting surface of the cathode which is smaller than at its base located closest to the emitting part. The filament may, for example, be spiralled on a cone, so as to increase the surface area of the filament directly facing the surface of the cap 11 located under the emitting part and to decrease its mean distance from the surface.

In the case of an impregnated cathode, it is still possible to improve the heat exchange by placing at least part of a turn of the filament 13 around the side wall 21 of the pellet, as illustrated in FIG. 2 and FIG. 3.

In general, it is possible to improve the heat exchange between the filament 13 and the emitting part 10 by adapting the geometric shapes of components emitting part 10, cap 11, filament 13 and skirt 14 so as to favour transfer by heat radiation:

from filament 13 to emitting part 10, by increasing the surface areas of filament 13 and emitting part 10 directly in line with each other (more exactly, directly in line through component 11), and by decreasing the space between the surfaces; and from filament 13 to skirt 14, by increasing the surface areas of filament 13 and skirt 14 directly in line with each other, and by decreasing the space between the surfaces.

Moreover, the use of leads 15 as cathode support makes it possible, compared with a structure according to the state of the art, to decrease thermal losses, on the one hand by radiation and on the other hand by conduction, in the cathode support components such as the sleeve 7 of FIG. 1.

Apart from the fact that the cathode structure according to the invention makes it possible both to reduce the size of the cathode and to improve its heat efficiency, the fact of having a filament closer to the emitting part with a lower part of the skirt in the form of a heat reflector makes it possible in addition to improve it by decreasing the cathode startup time thereof, the startup time corresponding to the time elapsing between applying the supply voltage to the filament and obtaining the electron current emitted by the cathode.

What is claimed is:

1. A cathode for an electron gun of a cathode-ray tube comprising an emitting part composed of emitting materials in order to generate an electron beam, a metal cap on which said emitting part is placed, a heater filament, of spiral shape, placed under the cap and terminated by connection leads, a skirt having an internal surface and surrounding the spiral part of said filament and forming, with said cap, a closed space, wherein said internal surface of a rear part of said skirt opposite said cap has a frustoconical shape adapted to reflect heat energy from said filament towards said emitting part, wherein turns of said filament decrease in diameter as they move away from said emitting part.

2. The cathode according to claim 1, wherein said emitting part is a pellet impregnated with emitting material and the turn closest to said emitting part surrounds, at least partially, a side wall of said impregnated pellet.

3. The cathode according to claim 1, wherein said skirt has openings through which said leads pass, placed on a lateral wall of said skirt close to said cap.

4. The cathode according to claim 1, wherein said cathode is held in said gun using a rigid support, at least one of said leads acting as a mechanical connection from said cathode to said cathode support.

5. The cathode according to claim 4, wherein said cathode support consists mainly of an electrically insulating material.

6. The cathode according to claim 5, wherein the cathode support includes electrically conducting pads.

7. A cathode for an electron gun of a cathode-ray tube comprising an emitting part composed of emitting materials to emit an electron beam, a metal cap on which said emitting part is placed, a heater filament of spiral shape, placed under said cap and terminated by connection leads, a skirt surrounding the spiral part of said filament, said skirt being secured to said cap, said skirt having a side wall and a periphery, said side wall of said skirt having openings for the connecting leads to pass through, wherein said filament comprises turns which decrease in diameter as they move away from said emitting part.

8. The cathode according to claim 7, wherein said openings through which said leads pass are notches placed in said periphery of said skirt close to said cap.

9. The cathode according to claim 7, wherein said cathode is held in said gun using a rigid support and at least one of said leads acts as a mechanical connection from said cathode to said support.

10. The cathode according to claim 9, wherein said cathode support consists mainly of an electrically insulating material.

11. The cathode according to claim 10, wherein said cathode support includes electrically conducting pads.

12. The cathode according to claim 7, wherein said emitting part is a pellet impregnated with emitting material and the turn closest to said emitting part surrounds, at least partially, the side wall of said impregnated pellet.

13. The cathode according to claim 7, wherein an end of said skirt opposite said cap is closed so that a portion of said filament is enclosed in a hollow body formed by said cap and said skirt.

14. The cathode according to claim 7, wherein said shape of said skirt is substantially frustoconical in order to reflect heat energy emitted by said filament onto said emitting part.

* * * * *